US009862030B2

(12) United States Patent
Onimura et al.

(10) Patent No.: US 9,862,030 B2
(45) Date of Patent: Jan. 9, 2018

(54) METHOD FOR PRODUCING ALLOY CAST SLAB FOR RARE EARTH SINTERED MAGNET

(75) Inventors: Takuya Onimura, Kobe (JP); Shinya Tabata, Kobe (JP)

(73) Assignee: SANTOKU CORPORATION, Kobe-shi, Hyogo (JP)

( * ) Notice: Subject to any disclaimer, the term of this patent is extended or adjusted under 35 U.S.C. 154(b) by 989 days.

(21) Appl. No.: 13/807,909

(22) PCT Filed: Jul. 1, 2011

(86) PCT No.: PCT/JP2011/065171
§ 371 (c)(1),
(2), (4) Date: Feb. 19, 2013

(87) PCT Pub. No.: WO2012/002531
PCT Pub. Date: Jan. 5, 2012

(65) Prior Publication Data

US 2013/0142687 A1 Jun. 6, 2013

(30) Foreign Application Priority Data

Jul. 2, 2010 (JP) ..... 2010-164322

(51) Int. Cl.
*B22F 9/08* (2006.01)
*B22D 11/00* (2006.01)
(Continued)

(52) U.S. Cl.
CPC ..... *B22F 9/08* (2013.01); *B22D 11/001* (2013.01); *B22D 11/0611* (2013.01); *C21D 6/00* (2013.01);
(Continued)

(58) Field of Classification Search
CPC ..... C22C 38/00; C22C 38/005; H01F 1/01; H01F 1/0571; H01F 1/0577; H01F 1/20;
(Continued)

(56) References Cited

U.S. PATENT DOCUMENTS 6,793,742 B2 * 9/2004 Sakaki ..... C22C 1/0441 148/101
7,722,726 B2 * 5/2010 Shintani ..... B22F 1/0055 148/101
(Continued)

FOREIGN PATENT DOCUMENTS

CN 1460270 A 12/2003
CN 1842385 A 10/2006
(Continued)

OTHER PUBLICATIONS

Li Yu Dunbo (JP2008264875) (Attached English translation).*
(Continued)

*Primary Examiner* — Keith Walker
*Assistant Examiner* — John Hevey
(74) *Attorney, Agent, or Firm* — Sughrue Mion, PLLC

(57) ABSTRACT

Provided are alloy flakes for rare earth sintered magnet, which achieve a high rare earth component yield after pulverization with respect to before pulverization and a uniform particle size after pulverization, and a method for producing such alloy at high energy efficiency in an industrial scale. The method includes (A) preparing an alloy melt containing R composed of at least one element selected from rare earth metal elements including Y, B, and the balance M composed of Fe, or of Fe and at least one element selected from transition metal elements other than Fe, Si, and C, (B) rapidly cooling/solidifying the alloy melt to not lower than 700° C. and not higher than 1000° C. by strip casting with a cooling roll, and (C) heating and maintaining, in a par-
(Continued)

ticular temperature range, alloy flakes separated from the roll by rapid cooling and solidifying in step (B) before the flakes are cooled to not higher than 500° C., to obtain alloy flakes having a composition of 27.0 to 33.0 mass % R, 0.90 to 1.30 mass % boron, and the balance M.

4 Claims, 5 Drawing Sheets
(1 of 5 Drawing Sheet(s) Filed in Color)

(51) Int. Cl.

| | |
|---|---|
| ***C21D 6/00*** | (2006.01) |
| ***C22C 1/04*** | (2006.01) |
| ***C22C 38/00*** | (2006.01) |
| ***C22C 38/10*** | (2006.01) |
| ***C22C 38/16*** | (2006.01) |
| ***B22D 11/06*** | (2006.01) |
| ***C22C 33/02*** | (2006.01) |
| ***H01F 1/057*** | (2006.01) |
| ***C22C 38/06*** | (2006.01) |

(52) U.S. Cl.
CPC ..... *C22C 1/04* (2013.01); *C22C 33/02* (2013.01); *C22C 38/002* (2013.01); *C22C 38/005* (2013.01); *C22C 38/06* (2013.01); *C22C 38/10* (2013.01); *C22C 38/16* (2013.01); *H01F 1/0571* (2013.01); *B22F 2998/10* (2013.01); *C21D 2211/004* (2013.01); *C22C 2202/02* (2013.01)

(58) Field of Classification Search
CPC ..... B22F 9/08; B22D 11/00; B22D 11/06; B22D 11/0651; B22D 1/055
USPC ..... 420/83; 148/302
See application file for complete search history.

(56) References Cited

U.S. PATENT DOCUMENTS

| | | | | |
|---|---|---|---|---|
| 8,042,600 | B2 * | 10/2011 | Nakajima | B22F 1/0055 164/269 |
| 2004/0163737 | A1 | 8/2004 | Tomizawa et al. | |
| 2005/0028892 | A1 | 2/2005 | Sasaki | |
| 2006/0076719 | A1 | 4/2006 | Yamamoto et al. | |
| 2007/0199624 | A1 | 8/2007 | Shintani et al. | |
| 2007/0261766 | A1 | 11/2007 | Tomizawa et al. | |
| 2007/0266822 | A1 * | 11/2007 | Sasaki | B22F 1/0007 75/229 |
| 2010/0200121 | A1 * | 8/2010 | Shintani | B22F 1/0055 148/302 |
| 2010/0202917 | A1 | 8/2010 | Nakajima | |
| 2010/0230013 | A1 | 9/2010 | Nakajima | |
| 2011/0236712 | A1 * | 9/2011 | Masago | C23C 28/021 428/600 |
| 2014/0134040 | A1 * | 5/2014 | Tabata | B22D 11/00 420/83 |

FOREIGN PATENT DOCUMENTS

| | | | | |
|---|---|---|---|---|
| EP | 2193864 | A1 | 6/2010 | |
| JP | 8-150442 | A | 6/1996 | |
| JP | 8-264363 | A | 10/1996 | |
| JP | 2639609 | B2 | 8/1997 | |
| JP | 2004-143595 | A | 5/2004 | |
| JP | 2004-181531 | A | 7/2004 | |
| JP | 2007-067419 | A | 3/2007 | |
| JP | 2008264875 | * | 11/2008 | B22D 11/06 |
| WO | 2005/105343 | A1 | 11/2005 | |
| WO | 2009075351 | A1 | 6/2009 | |

OTHER PUBLICATIONS

Wang et al. (INTECH, Chapter 6) (Attached pdf file).*
European Patent Office Communication dated Sep. 1, 2016, mailed in counterpart European Application No. 11800993.5.
International Searching Authority, Translation of the International Preliminary Report on Patentability issued in corresponding International Application No. PCT/JP2011/065171, dated Feb. 12, 2013.

* cited by examiner

METHOD FOR PRODUCING ALLOY CAST SLAB FOR RARE EARTH SINTERED MAGNET

CROSS REFERENCE TO RELATED APPLICATIONS

This application is a National Stage of International Application No. PCT/JP2011/065171 filed Jul. 1, 2011, claiming priority based on Japanese Patent Application No. 2010-164322 filed Jul. 2, 2010, the contents of all of which are incorporated herein by reference in their entirety.

FIELD OF ART

The present invention relates to a method for producing alloy flakes for rare earth sintered magnets, and alloy flakes for rare earth sintered magnets.

BACKGROUND ART

Magnets for various motors used in vehicles, wind power generation, and the like are demanded to have still greater magnetic properties in order to meet social needs for downsizing and weight saving of electronic devices, and for energy and resource saving to cope with global warming, which has been becoming obvious. Among various measures taken, development of $Nd_2Fe_{14}B$ based rare earth sintered magnets having a high magnetic flux density have actively been made. As the applications of the $Nd_2Fe_{14}B$ based rare earth sintered magnets are broadened, needs for reduction of the price of the magnets are increasing, and improvement of yield and productivity in magnet production are desired.

A $Nd_2Fe_{14}B$ based rare earth sintered magnet is generally prepared by melting and casting a starting material, pulverizing the resulting rare earth magnet alloy into magnet alloy powder, molding the powder in the magnetic field, sintering and ageing the molded product. Pulverization of the rare earth magnet alloy is performed generally by the combination of hydrogen decrepitation effected by subjecting the rare earth magnet alloy to hydrogen absorption/desorption and jet milling effected by bombardment of the rare earth magnet alloy in a jet stream. The rare earth magnet alloy used for the production of a $Nd_2Fe_{14}B$ based rare earth sintered magnet contains a $Nd_2Fe_{14}B$ based compound phase (sometimes referred to as the 2-14-1 main phase hereinbelow) as the main phase, and an R-rich phase containing more rare earth metal elements than the 2-14-1 main phase (sometimes referred to simply as the R-rich phase hereinbelow). During hydrogen decrepitation, the rare earth magnet alloy is cracked due to the difference in hydrogen absorption rate between the 2-14-1 main phase and the R-rich phase.

As a method for producing a rare earth magnet alloy, Patent Publication 1 discloses a method for casting an alloy having finely-dispersed R-rich phases by rapid cooling and solidifying such as strip casting. This publication also teaches that such a rare earth magnet alloy, having finely-dispersed R-rich phases, has good pulverizability, so that, after sintering, the crystal grains of the 2-14-1 main phase are uniformly coated with the R-rich phases, which provides improved magnetic properties.

Patent Publication 2 discloses that a magnet produced from a rare earth magnet alloy wherein the average distance between R-rich phases is 3 to 12 μm, the value obtained by dividing the standard deviation of the distance between R-rich phases by the average distance between R-rich phases is not more than 0.25, and the volume ratio of the 2-14-1 main phase is not less than 88 vol %, provides improved magnetic remanence, coercivity, and maximum energy product. The publication discloses that this rare earth magnet alloy is obtained by melting a starting material into an alloy melt, supplying the alloy melt onto a roll or a disk to cool and solidify the melt with the average cooling rate until the resulting alloy flakes are separated from the roll or the disk controlled to 50 to 1200° C./sec., cooling the alloy flakes separated from the roll or the disk with the average cooling rate down to a predetermined alloy temperature T+30° C. controlled to not slower than 30° C./sec., and maintaining the alloy flakes in a predetermined temperature range of T±30° C. for 5 to 600 sec.

Patent Publication 3 discloses a method of making a material alloy for an R-T-Q based rare earth magnet including the steps of: preparing a melt of an R-T-Q based rare earth alloy, where R is rare earth elements, T is a transition metal element, Q is at least one element selected from the group consisting of B, C, N, Al, Si, and P, and the rare earth elements R include at least one element RL selected from the group consisting of Nd, Pr, Y, La, Ce, Sm, Eu, Gd, Er, Tm, Yb, and Lu and at least one element RH selected from the group consisting of Dy, Tb, and Ho; cooling the melt of the alloy to a temperature of 700° C. to 1000° C. as first cooling process, thereby making a solidified alloy, maintaining the solidified alloy at a temperature within the range of 700° C. to 900° C. for 15 seconds to 600 seconds; and cooling the solidified alloy to a temperature of 400° C. or less as a second cooling process. This publication also discloses that, in the rare earth magnet alloy obtained by this method, the concentration of the element RH in a portion of the R-rich phase, which is in contact with an interface between the main phase and the R-rich phase, is lower than that of the element RH in a portion of the main phase, which is also in contact with the interface, and crystal grains that form the main phase have minor-axis sizes of 3 μm to 10 μm.

Patent Publication 1: JP-2639609-B
Patent Publication 2: JP-2004-143595-A
Patent Publication 3: WO 2005/105343

SUMMARY OF THE INVENTION

It is an object of the present invention to provide alloy flakes for a rare earth sintered magnet which provide, in magnet production, a high yield of rare earth components in pulverization and a uniform particle size after the pulverization, and to provide a method for producing such alloy flakes at high energy efficiency in an industrial scale.

With alloy flakes for a rare earth sintered magnet cast by rapid cooling and solidifying, control of the crystal grain size of the 2-14-1 main phase, improvement of the size uniformity, and control of the composition of the rare earth components in the R-rich phase and the main phase have conventionally been made by heating and maintaining the alloy flakes in a particular temperature range before the alloy flakes are cooled down to near room temperature.

However, no discussion has been made as to the impact that the alloy flakes for a rare earth sintered magnet produced through such a process have, in magnet production, on the yield of rare earth components in pulverization and the particle size distribution after the pulverization. The present inventors have determined that the alloy flakes for a rare earth sintered magnet that have been subjected to consecutive cooling/solidifying and heating under the particular conditions bring about a high yield of rare earth components in pulverization and a uniform particle size of pulverized powder in magnet production, to thereby complete the present invention.

According to the present invention, there is provided a method for producing alloy flakes for a rare earth sintered magnet, said alloy flakes having a composition of 27.0 to 33.0 mass % R consisting of at least one element selected from the group consisting of rare earth metal elements including yttrium, 0.90 to 1.30 mass % boron, and the balance M consisting of iron, or of iron and at least one element selected from the group consisting of transition metal elements other than iron, silicon, and carbon, said method comprising the steps of:

(A) preparing an alloy melt comprising R, boron, and the balance M, (B) rapidly cooling and solidifying said alloy melt by strip casting with a cooling roll down to not lower than 700° C. and not higher than 1000° C., and (C) heating alloy flakes separated from the cooling roll by said rapid cooling and solidifying in step (B), before said alloy flakes are cooled down to not higher than 500° C., wherein said heating in step (C) is effected by maintaining the alloy flakes at higher than 900° C. and not higher than 1050° C. for 5 to 120 minutes (sometimes referred to as the present method).

According to the present invention, there is also provided alloy flakes for a rare earth sintered magnet prepared by the present method.

According to the present invention, there is further provided alloy flakes for a rare earth sintered magnet comprising R consisting of at least one element selected from the group consisting of rare earth metal elements including yttrium, boron, and the balance M consisting of iron, or of iron and at least one element selected from the group consisting of transition metal elements other than iron, silicon, and carbon, at a composition of 27.0 to 33.0 mass % R, 0.90 to 1.30 mass % boron, and the balance M, said alloy flakes having been obtained by strip casting with a cooling roll, wherein, in a micrograph at a magnification of 100× of a face of said alloy flake which was in contact with a cooling surface of the roll, the number of crystals is not less than 5 which are dendrites grown radially from a point of nucleation, have an aspect ratio of 0.5 to 1.0 and a crystal grain size of not smaller than 30 μm, and cross a line corresponding to 880 μm, and wherein, in a micrograph at a magnification of 200× of a cross section of said alloy flake generally perpendicular to the face which was in contact with the cooling surface of the roll, an average distance between R-rich phases is 10 to 30 μm.

Effect of the Invention

The alloy flakes according to the present invention bring about a high yield of rare earth components in pulverization and a uniform particle size of pulverized powder, in the production of sintered magnets. In the method of the present invention, casting and heat treatment of the alloy flakes are carried out under the particular conditions and possibly successively, so that the alloy flakes of the present invention may be produced at high energy efficiency and productivity.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

PREFERRED EMBODIMENTS OF THE INVENTION

Figure 1:
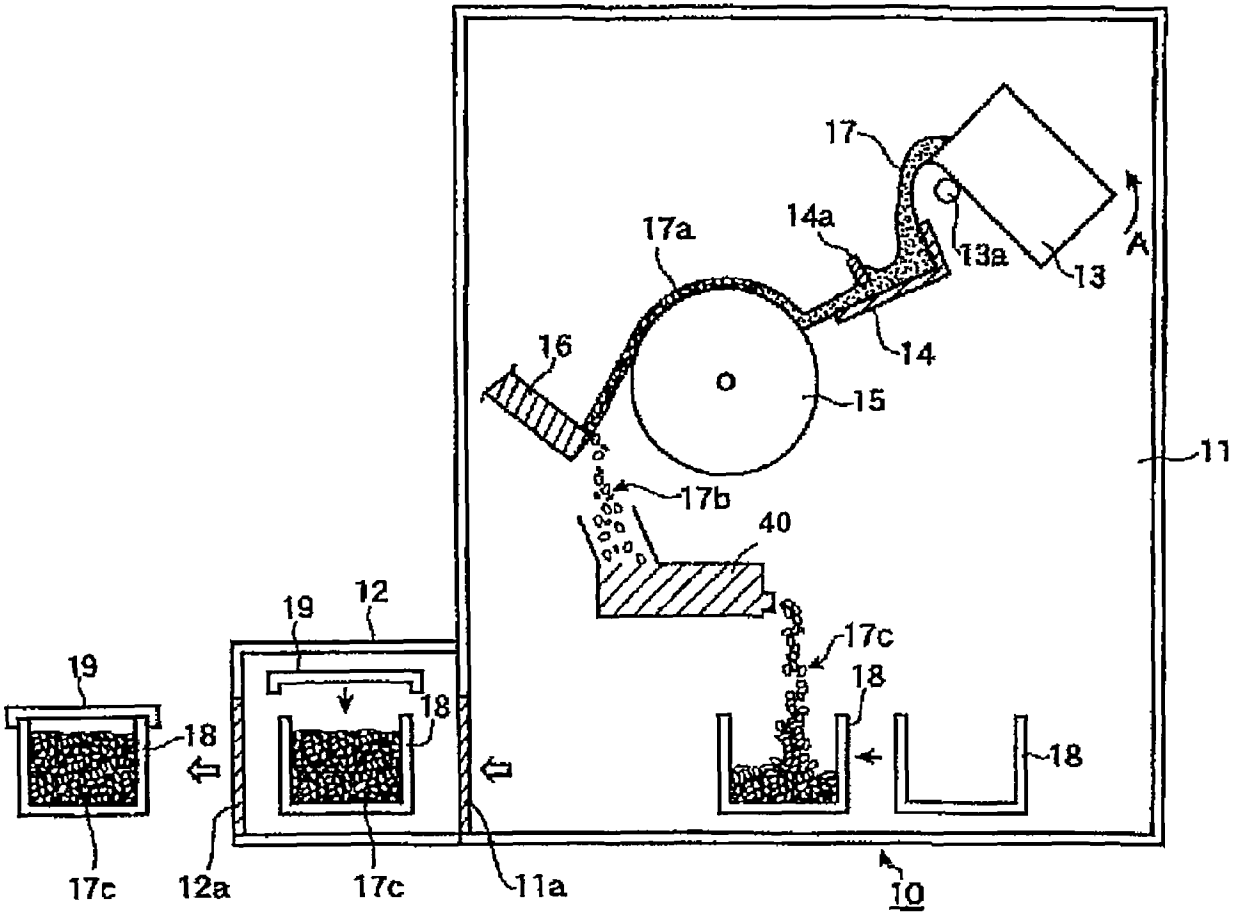
FIG. 1 is a schematic figure illustrating an example of the production system used in practicing the method of the present invention.

The present invention will now be explained in detail.

The present method includes step (A) of preparing a particular alloy melt as a starting material.

In step (A), the alloy melt contains R consisting of at least one element selected from the group consisting of rare earth metal elements including yttrium, boron, and the balance M consisting of iron, or of iron and at least one element selected from the group consisting of transition metal elements other than iron, silicon, and carbon, and may be prepared by heating and melting the above-mentioned materials in vacuum or an inert gas atmosphere using, for example, a crucible so as to have the composition to be discussed later.

The present method includes step (B) of rapidly cooling and solidifying the alloy melt by strip casting with a cooling roll down to not lower than 700° C. and not higher than 1000° C.

The cooling roll may be a single roll or twin rolls.

In step (B), the cooling rate in the rapid cooling and solidification is usually 300 to $1\times10^{4}$° C./sec., preferably 500 to 1000° C./sec. The cooling rate may be controlled according to a conventional method for controlling the temperature or feeding rate of the alloy melt, peripheral velocity, and the like. The alloy flakes obtained from this step have an alloy structure including dendrites of the R-rich phase and the 2-14-1 main phase, and a phase having a higher B concentration compared to the 2-14-1 main phase, mainly containing a $RFe_4B_4$ phase (sometimes referred to as the B-rich phase hereinbelow). However, the alloy flakes are still in a non-equilibrium state, and the R-rich phase contains more element M and boron than in the equilibrium state. The thicknesses of the alloy flakes are about 0.05 to 2 mm, preferably 0.2 to 0.8 mm.

The cooling roll used in step (B) preferably has non-linear irregularities on its surface with an Ra value of 2 to 15 μm and an Rsk value of not less than −0.5 and less than 0, more preferably, an Rsk value of not less than −0.4 and less than 0, and an Ra value of 2 to 8 μm. With such a cooling roll, release of the generated crystal nuclei from the roll surface may be suppressed. In other words, precipitation of chill crystals may be suppressed. In particular, with an Ra value within the above-mentioned range, the amount of nucleations may be controlled, and precipitation of chill crystals may be suppressed, so that alloy flakes of a homogenous structure may be obtained.

By means of the cooling roll mentioned above, as observed in a micrograph at a magnification of 100× of a face of an alloy flake which was in contact with the cooling surface of the roll, the number of crystals may be controlled to be not less than 5, preferably 8 to 15 which are dendrites grown radially from the point of nucleation, have an aspect ratio of 0.5 to 1.0 and a crystal grain size of not smaller than 30 μm, and cross a line corresponding to 880 μm. The number of such crystals will not be changed before and after maintaining the temperature in step (C) to be discussed later. When the number of the crystals is not less than 5, few chill crystals are observed on a cross section of an alloy flake perpendicular to the face which was in contact with the cooling surface of the roll. In maintaining the temperature in step (C) to be discussed later, chill crystals will not disappear and remain in the alloy flakes, which may adversely affect the yield of rare earth components in pulverization and the uniformity of the particle size of the pulverized powder in magnet production.

The surface texture of the cooling roll may be controlled by abrasion, laser machining, transcription, thermal spraying, shotblasting, or the like process. For example, when abrasion is employed, the roll may be abraded in the direction of rotation of the roll and then in the direction at 90° with respect to the direction of rotation. When thermal spraying is employed, the shape of the thermal spray material and the conditions of spraying may be controlled. In particular, an atypical thermal spray material having a high melting point may partly be mixed to the thermal spray material. When shotblasting is employed, the shape of the blasting material and the conditions of blasting may be controlled. In particular, blasting materials of various particle sizes, or atypical blasting materials may be used.

The present method includes step (C) of heating the alloy flakes separated from the cooling roll by the rapid cooling and solidifying in step (B), before the flakes are cooled down to not higher than 500° C.

The heating in step (C) is effected by maintaining the alloy flakes at higher than 900° C. and not higher than 1050° C. for 5 to 120 minutes. The holding temperature is preferably not lower than 950° C. and not higher than 1050° C., more preferably not lower than 1000° C. and not higher than 1050° C.

Under the heating conditions in step (C), the alloy flakes approach the equilibrium state, the volume ratio of the 2-14-1 main phase is increased while the volume ratio of the R-rich phase is decreased, and the magnetic properties, particularly the magnetic remanence is improved. Since part of the R-rich phases is diffused to disappear, the distance between the R-rich phases becomes broader.

In the resulting alloy flakes, the average distance between the R-rich phases in a cross-section perpendicular to the face which was in contact with the roll surface is preferably 10 to 30 μm, more preferably 12 to 25 μm.

With the above-mentioned average distance between the R-rich phases achieved by the heating in step (C), a high yield of rare earth components in pulverization of the alloy flakes and a uniform particle size of the alloy powder resulting from pulverization may be achieved in magnet production.

In pulverization of the alloy flakes in magnet production, fine powders resulting from jet milling are collected in a scrubber or a bag filter and discarded. Since the R-rich phase is prone to decrepitation, the collected powders contain a major amount of rare earth components. Alloy flakes which have not undergone the heating in step (C) have a high volume ratio of the R-rich phases, whereas the alloy flakes which have undergone the heating contain coarsened dendrites, i.e., have a high volume ratio of the 2-14-1 main phases, so that the volume ratio of the R-rich phases is low. As such, the amount of rare earth components in the powders to be discarded is small, and thus the yield is high.

According to the present method, variation of the distances between the R-rich phases may be limited. By limiting the variation, the alloy powder resulting from pulverization may be given a uniform particle size with a desired distribution. The value obtained by dividing the standard deviation of the distance between the R-rich phases by the average distance between the R-rich phases, which is an index of variation of the distances between the R-rich phases, is preferably not more than 0.20, more preferably not more than 0.18. With such alloy flakes, the uniformity of the alloy powder resulting from pulverization may be controlled to not less than 2.0. With the alloy powder having such a uniformity, extraordinarily large crystal grain growth will not occur in a sintering step of magnet production, so that the magnet coercivity may be improved.

The average distance between the R-rich phases may be determined in the following manner.

First, an optical micrograph of the sectional structure of an alloy flake of the present invention perpendicular to the face which was in contact with the cooling surface of the roll (parallel to the direction of thickness of the flake) is taken at a magnification of 200×. The R-rich phases are present as boundary phases of the dendrites of the 2-14-1 main phases. The R-rich phases are usually present in the form of lines, but may be in some cases in the form of islands depending on the thermal history or the like during casting. Even when the R-rich phases are in the form of islands, if the islands are arranged in series to apparently form lines, the islands of the R-rich phases are connected and regarded as linear R-rich phases. Three lines each corresponding to 440 μm are drawn on the face of an alloy flake of the present invention which was in contact with the cooling surface of the roll, as if the face is divided into four in the direction perpendicular to the contact face. The number of the R-rich phases crossing each line is counted, and the length of the line, 440 μm, is divided by the number. Ten of the alloy flakes were subjected to the same measurement to obtain thirty values, the average of which is taken as the average distance between the R-rich phases. The standard deviation is also calculated from the thirty measured values.

The uniformity of the alloy powder may be determined by the following manner.

The alloy flakes of the present invention are subjected to hydrogen decrepitation and jet milling to obtain alloy powder having an average particle size (D50) of 5 to 7 μm. The particle size distribution of the obtained alloy powder determined with a laser diffraction particle size analyzer is expressed in the Rosin-Rammler distribution to obtain a straight line, of which slope represents the uniformity. A larger uniformity represents more uniform particle sizes of the alloy powder. The uniformity is preferably not less than 2.0, more preferably not less than 2.1.

In step (C), with the heating at not higher than 900° C. or the holding time of shorter than 5 minutes, the volume ratio of the R-rich phases is not sufficiently lowered, so that the amount of rare earth components contained in the fine powder generated in jet milling is large and thus the yield is low. On the other hand, with the heating at higher than 1050° C. or the holding time of longer than 120 minutes, the alloy flakes are welded together or the crystal grains grow more than necessary, so that the pulverizability is deteriorated. Further, the heating of the alloy flakes obtained by rapid cooling and solidification after the alloy flakes are cooled down to not higher than 500° C., causes energy loss. Further, since the alloy flakes in a completely solidified state are subjected to heating, the thermal hi story within the alloy flakes becomes non-uniform, and the distances between the R-rich phases are likely to vary. When such alloy flakes are pulverized into alloy powders, the particle size distribution of the powders becomes broad, and the uniformity falls below 2.0.

The heating and maintaining in step (C) may be carried out in an apparatus having a heating mechanism or the like. It is preferred that the obtained alloy flakes for a rare earth sintered magnet have a constant thermal hi story within a casting lot. For example, when the alloy is collected in a container which is made of a highly heat-insulating material and capable of maintaining temperature, many of the alloys produced right after the commencement of casting undergo thermal conduction by direct contact with the container, but as the casting proceeds, the alloy flakes are built up in the container, and start thermal conduction by contacting one another, resulting in non-uniform thermal history. This may cause variation of the structures of the alloy flakes, and degradation of the magnetic properties. One way to make the thermal history constant is to continuously transfer the alloy flakes while maintaining the temperature.

Steps (A) to (C) of the present method may be carried out continuously in, for example, production system 10 shown in FIG. 1.

The production system 10 is composed of first air-tight chamber 11 of which interior may be made inert gas atmosphere or vacuum, and second chamber 12, which is optional.

The first chamber 11 includes melting furnace 13 for melting raw alloy materials, solidifying means composed of cooling roll 15 for cooling and solidifying alloy melt 17 pouring out of the melting furnace 13 into thin ribbons, tundish 14 for guiding the alloy melt 17 from the melting furnace 13 on to the cooling roll 15, and alloy crusher plate 16 for crushing the alloy ribbons 17*a* being separated from the cooling roll 15 simply by collision, device 40 for controlling alloy crystal structure by making the alloy crystal structure of the crushed alloy flakes 17*b* into a desired uniform state, and container 18, without a cooling device, for collecting the alloy flakes 17*c* discharged from the device 40. The chamber 11 has shutter 11*a* at a location communicating with the second chamber 12, which shutter may be opened and closed and capable of keeping air tightness.

The melting furnace 13 is structured to melt raw alloy materials therein, tilt around axis 13*a* to the direction of arrow A, and pour the alloy melt 17 into the tundish 14 by generally a constant amount.

The tundish 14 is shown in cross-section with the side walls for preventing outflowing of the alloy melt 17 over the side faces omitted, and has weir plate 14*a* for rectifying the alloy melt 17 flowing out of the melting furnace 13 to be supplied onto the cooling roll 15 at generally a constant rate.

The cooling roll 15 has the circumferential surface made of a material which is capable of cooling the alloy melt 17, such as copper, and is equipped with a drive unit (not shown) capable of rotating the roll at a constant angular velocity or the like.

The alloy crusher plate 16 is a plate-like member made of metal, and positioned for the alloy 17*a* being separated from the cooling roll 15 to continuously collapse.

The alloy flakes 17*b* crushed on the alloy crusher plate 16 usually have a surface temperature of not lower than 700° C., though it may vary depending on the alloy composition, cooling rate, and the like.

Figure 2:
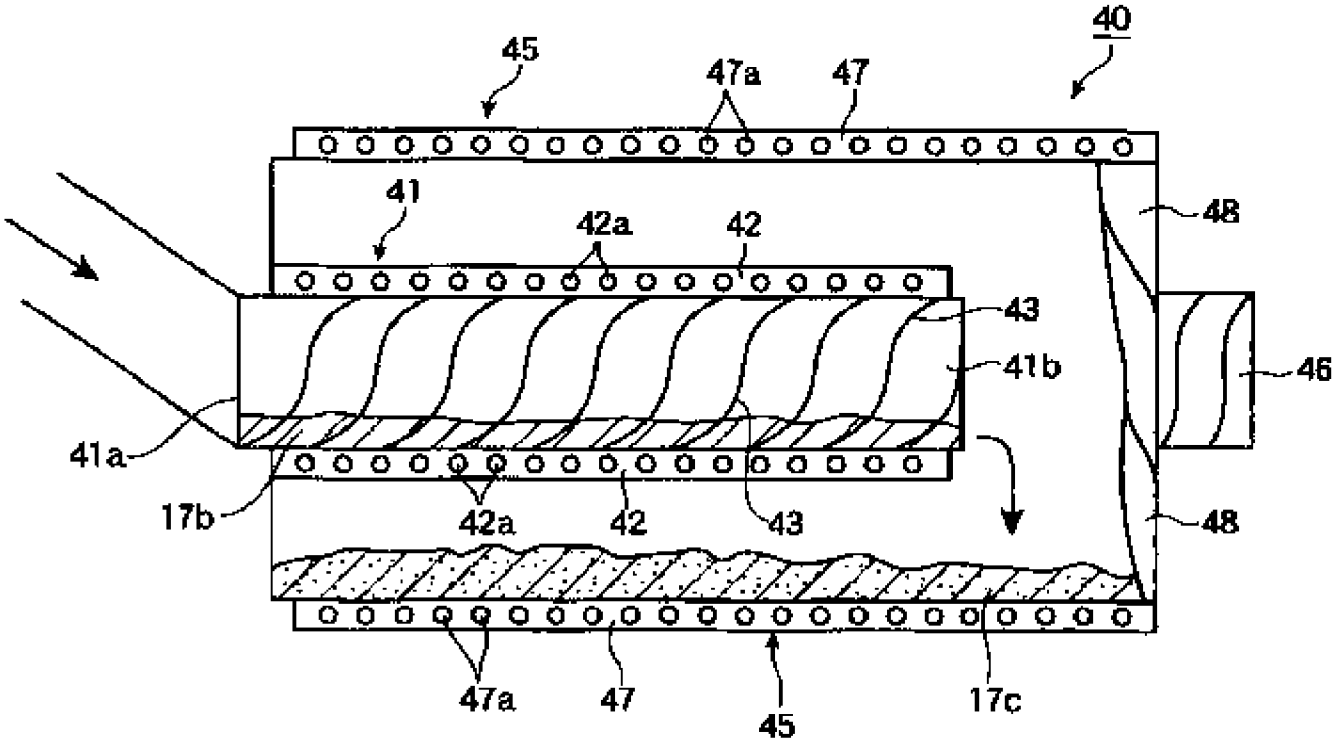
FIG. 2 is a schematic figure illustrating an example of a rotary kiln conveyer used in the production system of FIG. 1.

Referring now to FIG. 2, the device 40 for controlling alloy crystal structure is now discussed.

The device 40 for controlling alloy crystal structure is composed of a device for controlling alloy crystal structure and integrated cooling means, and may be positioned such that the surface temperature of the alloy flakes 17*b* crushed on the alloy crusher plate 16 shown in FIG. 1 does not go below the predetermined temperature mentioned above.

The device 40 includes pipe 41 which has inlet 41*a* for the alloy flakes 17*b*, outlet 41*b* for discharging the alloy flakes 17*c* of which alloy crystal structure has been controlled, and heating section 42 equipped with heating coils 42*a*, and which is rotatable and has a delivery space capable of continuously transferring the alloy flakes 17*b*. The device 40 also includes tubular cooler 45 arranged around and capable of coaxial rotation with the pipe 41. That is, the device 40 has the single pipe 41 as a device for controlling the alloy crystal structure of the alloy flakes 17*b*.

The pipe 41 is provided on its inner surface with fins 43 for carrying the introduced alloy flakes 17*b* toward the outlet 41*b* as the pipe 41 rotates.

The alloy flakes 17*b* introduced into the pipe 41 are maintained at a predetermined temperature by suitably operating the heating section 42, and further for a predetermined duration at the predetermined temperature by adjusting the rotational speed of the pipe 41 and/or the installation angle of the fins 43. By placing the alloy flakes 17*b* under control at the predetermined temperature for the predetermined duration, alloy flakes 17*c* having uniform alloy crystals of a desired crystal structure may be prepared effectively in a short time.

The tubular cooler 45 is a rotatable pipe having outlet 46 for discharging the alloy flakes 17*c* of which alloy crystals have been controlled, and cooling section 47 equipped with coolant circulation tube 47*a* which is capable of circulating a coolant. The tubular cooler 45 is structured such that its rotary axis tilts toward the outlet 46 for and upon discharging the forced-cooled alloy flakes 17*c* though the outlet 46 out of the pipe. The tubular cooler 45 is further provided with fins 48 inside the pipe on the side of the outlet, which fins do not act on the alloy flakes 17*c* during rotation for cooling, but guide the alloy flakes 17*c* toward the outlet 46 when the rotary axis is tilted and the pipe is rotated in reverse for discharging the alloy flakes 17*c* out of the pipe.

The tubular cooler 45 may optionally be provided on its inner surface additional fins (not shown) for allowing uniform contact of the alloy flakes 17*c* over the entire inner surface of the tubular cooler 45.

With the device 40, the alloy flakes may be forced-cooled while the alloy crystals are controlled to a desired structure, and the space efficiency of the production system 10 is improved. In this case, the container 18 shown in FIG. 1 does not have to have a cooling device, but without the device 40, the container 18 may be replaced with a container-shaped cooler. The atmosphere in which the alloy flakes 17*c* are placed in the container 18 is not necessarily an inert gas atmosphere, and the chamber 11 in which an inert gas atmosphere may be established may contain only the series of devices from the melting furnace 13 to the device 40. In this case, each device may not have to be contained in a single chamber 11, but may separately be contained in a chamber in which an inert gas atmosphere may be established, and connected in line with connecting tubes.

The device 40 may further be provided with a shield valve (not shown) in an access line to the inlet 41*a* for the alloy flakes 17*b*, so that the device 40 may be shielded with the shield valve to establish an inert gas atmosphere therein. In this case, the device 40 is not necessarily contained in a chamber in which an inert gas atmosphere may be established.

By means of the production system 10 discussed above, or the like system, generally uniform alloy structure may be achieved in a casting lot. In this way, the alloy flakes of the present invention may be obtained which give the value of not more than 0.20 by dividing the standard deviation of the distance between the R-rich phases by the average distance between the R-rich phases.

The composition of the alloy flakes of the present invention is 27.0 to 33.0 mass % R, 0.90 to 1.30 mass % boron, and the balance M. The preparation of the raw materials may be made, taking evaporation of the elements during the melting, casting, and heat treatment into account.

As R, the rare earth metal elements including yttrium mean lanthanoides of atomic numbers 57 to 71 and yttrium of atomic number 39. The R is not particularly limited, and may preferably be, for example, lanthanum, cerium, praseodymium, neodymium, yttrium, gadolinium, terbium, dysprosium, holmium, erbium, ytterbium, or a mixture of two or more of these. It is particularly preferred that R contains at least one heavy rare earth element selected from the group consisting of gadolinium, terbium, dysprosium, holmium, erbium, and ytterbium. These heavy rare earth elements particularly improve coercivity among other magnetic properties. Terbium particularly has the most significant effect, but is expensive. In view of the cost and effect, it is preferred to use dysprosium alone or in combination with gadolinium, terbium, holmium, and the like.

At less than 27.0 mass % R, the amount of a liquid phase required for densification of a sintered rare earth magnet will be insufficient, resulting in low density of the sintered body and poor magnetic properties. At over 33.0 mass % R, the ratio of the R-rich phases in the sintered body will be too high, causing decreased corrosion resistance. This naturally decreases the volume ratio of the 2-14-1 main phases, which deteriorates magnetic remanence.

When the alloy flakes of the present invention are to be used in a single alloy method, the content of R is preferably 29.0 to 33.0 mass %, whereas when the alloy flakes are to be used as the 2-14-1 main phase alloy in a two-alloys method, the content of R is preferably 27.0 to 29.0 mass %.

The content of the heavy rare earth elements, when used as R, is usually 0.2 to 15 mass %, preferably 1 to 15 mass %, more preferably 3 to 15 mass %. At more than 15 mass %, the cost is too high, whereas at less than 0.2 mass &, the effect is too little.

At less than 0.90 mass % boron, the ratio of the 2-14-1 main phases is low and the magnetic remanence is not sufficient, whereas at over 1.30 mass % boron, the ratio of the B-rich phases is increased to lower both the magnetic properties and the corrosion resistance.

The balance M contains iron as a requisite element. The content of iron in the balance M is usually not lower than 50 mass %, preferably not lower than 60 mass %. The balance M may optionally contain at least one element selected from the group consisting of transition metals other than iron, silicon, and carbon, and also inevitable impurities contained in an industrial scale production, such as oxygen and nitrogen.

The transition metals other than iron are not particularly limited, and may preferably be, for example, at least one element selected from the group consisting of cobalt, aluminum, chromium, titanium, vanadium, zirconium, hafnium, manganese, magnesium, copper tin, tungsten, niobium, and gallium.

The alloy flakes of the present invention may have one or more B-rich phases in 50 micrometers square as observed in an EPMA image of the alloy flake at a magnification of 2000× on a cross section perpendicular to the face which was in contact with the cooling surface of the roll. The number of the B-rich phases, if present, is preferably 1 to 10 in 50 micrometers square. More preferably 1 to 5 B-rich phases are present in 50 micrometers square. With 1 to 10 B-rich phases in 50 micrometers square, crystal grain growth during sintering is suppressed, and the magnetic properties of the rare earth magnet, particularly the coercivity is improved.

As mentioned above, the alloy obtained by rapidly cooling and solidifying the alloy melt down to not lower than 700° C. and not higher than 1000° C. in step (B) of the present method is in a non-equilibrium state. Thus the 2-14-1 main phases have not been grown sufficiently, and the grain boundary R-rich phases have relatively high element M and boron contents. It is assumed that the B-rich phases are finely dispersed in the R-rich phases to the extent that cannot be confirmed by the method of observation of the B-rich phases to be discussed later.

In next step (C), by maintaining the rapidly cooled and solidified alloy at higher than 900° C. and not higher than 1050° C. before the alloy is cooled down to not higher than 500° C., the 2-14-1 main phase crystal grains grow to gradually increase their volume ratio, while the volume ratio of the grain boundary R-rich phases is gradually decreased, and the grain boundaries are shifted. The decrease and shift of the R-rich phases broaden the distance between the R-rich phases, and the finely dispersed B-rich phases aggregate in the decreased R-rich phases to the extent that more than ten B-rich phases may be observed by the method of observation of the B-rich phases to be discussed later. Further, with the lapse of time, the distance between the R-rich phases becomes still broader due to the increase in volume ratio and crystal grain growth of the 2-14-1 main phases, and the decrease of the R-rich phases and the shift of the grain boundaries. Meanwhile, the B-rich phases are consumed in the formation of the 2-14-1 phases, 1 to 10 B-rich phases are observed, and at some stage the alloy reaches the equilibrium state where few B-rich phases are observed.

The alloy flakes of the present invention are in the transitional state from the non-equilibrium state of the alloy flakes after the rapid cooling and solidification to the equilibrium state. In this state, the fine 2-14-1 main phases and the R-rich phases present after the rapid cooling and solidification have been disappeared, so that the fine powder discarded after pulverization in magnet production is decreased, and the yield of rare earth components after pulverization with respect to before pulverization is improved. The average distance between the R-rich phases is not too large and causes good pulverizability.

The number of the B-rich phases present in 50 micrometers square may be determined in the following method.

First, a cross section of an alloy flake for a rare earth sintered magnet generally perpendicular to the face which was in contact with the cooling surface of the roll is observed with EPMA at a magnification of 2000×, accelerating voltage of 15 kV, current of $2\times10^{-7}$ A, and a beam diameter of 300 nm. When the alloy flakes of the present invention do not contain Dy, the B-rich phases are observed as B-concentrated part in a mapping image of B, whereas when the alloy flakes contain Dy, since $DyFe_4B_4$ phases are formed preferentially, the B-rich phases are observed as B- and Dy-concentrated part in a mapping image of B and Dy. When the balance M contains Zr, Nb, or the like, these elements form a compound phase with B and are observed as B-concentrated part in a mapping image of B. In the present invention, a compound phase of the balance M and B without R is not included in the B-rich phase. Ten of the alloy flakes selected at random were observed by one filed each, and the number of the B-rich phases was counted. The average of the counts was taken as the number of the B-rich phases present in 50 micrometers square.

The alloy flakes according to the present invention have, as observed in a micrograph at a magnification of 100× of a face of a flake which was in contact with the cooling surface of the roll, not less than 5 crystals which are dendrites grown radially from the point of nucleation, have an aspect ratio of 0.5 to 1.0 and a crystal grain size of not smaller than 30 μm, and cross a line corresponding to 880 μm. Preferably the alloy flakes have not less than 8 and not more than 15 such crystals. Usually, the number of the crystals obtained in industrial scale production is not more than 30. The face which was in contact with the cooling surface of the roll means the face which was solidified by contacting the cooling roll. In the alloy flakes having not less than 5 such crystals, formation of chill crystals is hardly observed in a cross section of the flake perpendicular to the face which was in contact with the cooling surface of the roll. When such alloy flakes are used for magnet production, the yield of rare earth components in a pulverization process is high, and the particle size distribution after the pulverization is uniform.

The determination of the number of the crystals mentioned above was made as follows. In the 100× micrograph of an alloy flake, boundaries of dendrites grown radially from each point of nucleation formed a closed curve. This was taken as one crystal, and the average of the short axis and the long axis of the closed curve was taken as the grain size. The ratio between the length of the short axis and the length of the long axis was taken as the aspect ratio. Three lines each corresponding to 880 μm were drawn in the observation field as if the field was divided into four, and the number of the crystals was counted which were dendrites grown radially from a point of nucleation, had an aspect ratio of 0.5 to 1.0 and a crystal grain size of not smaller than 30 μm, and crossed each line. The average of the numbers was taken as the number of such crystals.

The alloy flakes of the present invention are preferably free of α-Fe phases, but may contain α-Fe phases as far as the phases do not have significant adverse effect on pulverizability. Usually, α-Fe phases appear where the cooling rate of the alloy is slow. For example, when an alloy is produced by a single-roll strip casting, the α-Fe phases appear on the free face (the face which is not cooled with the roll). The α-Fe phases, if contained, are preferably precipitated at crystal grain sizes of not larger than 3 μm, and in a volume ratio of less than 5%. More preferably, the alloy flakes do not contain the α-Fe phases.

The alloy flakes of the present invention are preferably free of fine equiaxed crystal grains, i.e., chill crystals, but may contain the chill crystals as far as the crystals do not have significant adverse effect on pulverizability. Chill crystals appear where the cooling rate of the alloy is fast. For example, when an alloy is produced by a single-roll strip casting, the chill crystals appear on the face cooled with the roll. The chill crystals, if contained, are preferably in a volume ratio of less than 5%. More preferably, the alloy flakes do not contain the chill crystals.

EXAMPLES

The present invention will now be explained with reference to Examples and Comparative Examples, which do not limit the present invention.

Example 1

An alloy was prepared in the following method using the production system 10 shown in FIG. 1 and the device 40 shown in FIG. 2.

Raw materials, Nd, Pr, Dy, B, Co, Cu, Al, and Fe were blended so that the total weight was 300 kg. The raw materials were heated to melt in an argon atmosphere, poured at 1450° C. onto the cooling roll 15, which was a water-cooled copper roll, via the tundish 14 to solidify continuously. The peripheral velocity of the cool ing roll 15 was 1.0 m/sec. The alloy 17*a* rapidly cooled and solidified to 800 to 1000° C. on the cooling roll 15 was crushed on the alloy crusher plate 16 into alloy flakes 17*b*, and allowed to fall into the inlet 41*a* of the device 40. The fallen alloy flakes 17*b* were introduced into the pipe 41 of the device 40 while their surface temperature was not lower than 500° C., and maintained at 950° C. for 5 minutes as the flakes 17*b* were continuously transferred through the pipe 41. The alloy flakes 17*b* were then introduced into the pipe 45, forced-cooled down to not higher than 100° C., and collected in the container 18. The obtained alloy flakes 17*c* had thicknesses of 220 to 260 μm.

The composition of the obtained alloy flakes was analyzed with X-ray fluorescence and ICP to be 24.00 mass % Nd, 6.00 mass % Pr, 2.50 mass % Dy, 0.99 mass % B, 1.00 mass % Co, 0.3 mass % Al, 0.10 mass % Cu, and the balance Fe. The average distance between the R-rich phases, the value obtained by dividing the standard deviation of the distance between the R-rich phases by the average distance between the R-rich phases, and the number of the B-rich phases present in 50 micrometers square were determined of the obtained alloy flakes by the methods discussed above.

In order to determine the pulverizability and the content of the fine powder, the obtained alloy flakes were placed in a hydrogen reduction furnace, subjected to hydrogen absorption in a pressurized hydrogen atmosphere of 0.1 MPa at 30° C. for 3 hours, then dehydrogenation in vacuum at 530° C. for 2 hours, cooled to room temperature, and taken out. Then the alloy was pulverized in a jet mill at a nitrogen gas pressure of 0.6 kg/cm$^2$ and a material feed rate of 35 g/min. The compositional analyses were made before and after the jet milling, and the yield of the TRE components (Nd+Pr+Dy) after the jet milling compared to before the jet milling was determined. The alloy powder was also subjected to particle size measurement by laser diffraction to obtain the D50 value and the uniformity n. The results are shown in Table 1.

Examples 2 to 4 and Comparative Examples 1 to 3

Figure 3:
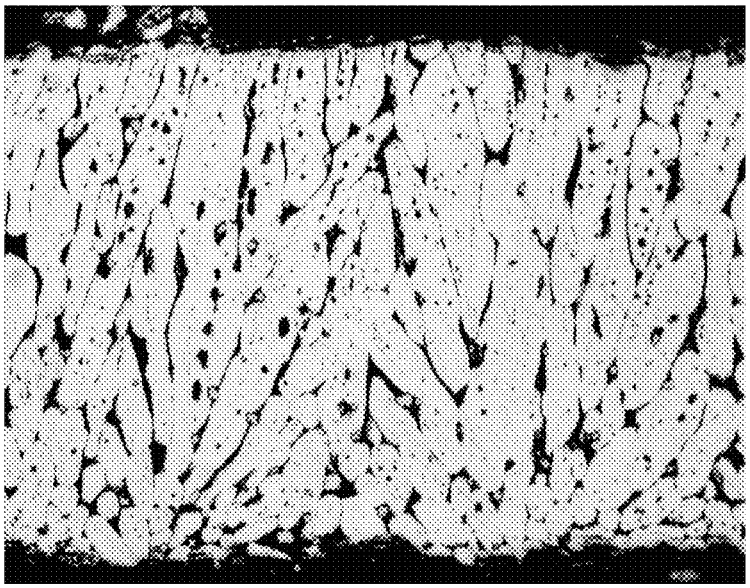
FIG. 3 is a copy of an optical micrograph of the alloy structure observed on a cross-section of an ally flake prepared in Example 2.
Figure 4:
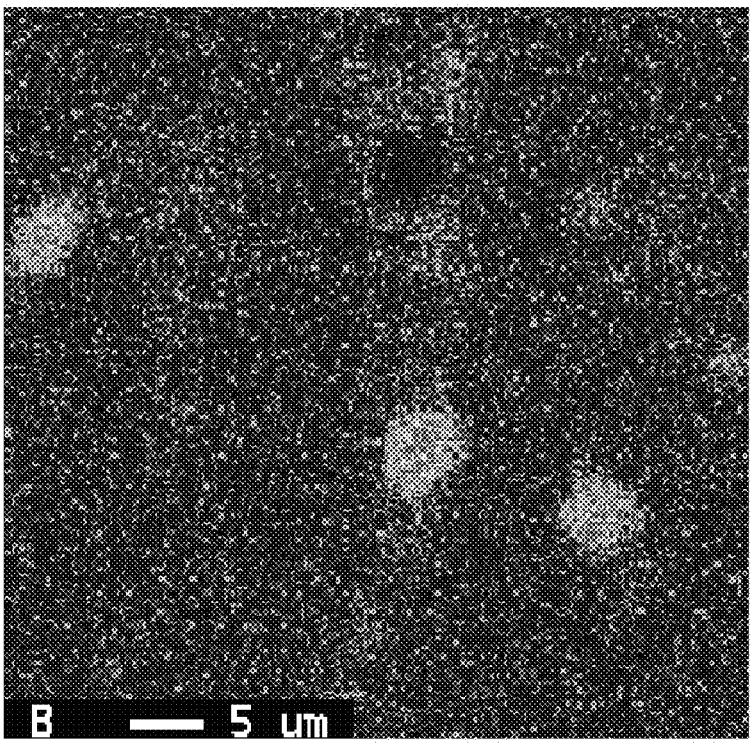
FIG. 4 is a mapping image of B observed with EPMA on a cross section of an alloy flake produced in Example 2.

Alloy flakes and pulverized powder were prepared in the same way as in Example 1 except that the heating temperature and the holding time were changed as shown in Table 1, and subjected to the evaluations and the measurements as in Example 1. The results are shown in Table 1. A copy of an optical micrograph of the alloy structure observed on a cross section of an alloy flake prepared in Example 2 is shown in FIG. 3, and the mapping image of B observed with EPMA on a cross section of an alloy flake prepared in Example 2 is shown in FIG. 4.

Comparative Example 4

Figure 5:
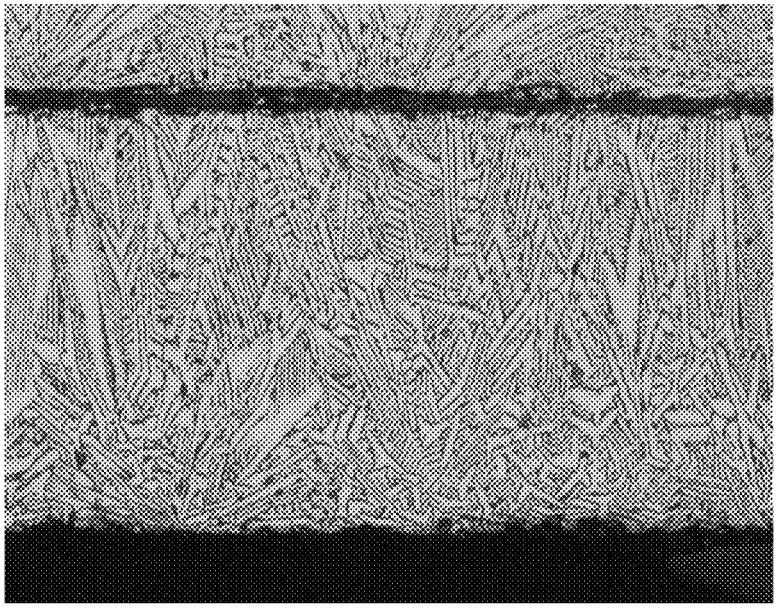
FIG. 5 is a copy of an optical micrograph of the alloy structure observed on a cross section of an alloy flake prepared in Comparative Example 4.

Procedures of Example 1 were followed except that the alloy was crushed on the alloy crusher plate 16 into alloy flakes and collected and cooled in the container 18 without using the device 40 in the production system 10 shown in FIG. 1. The obtained alloy flakes and the pulverized powder prepared in the same way as in Example 1 were subjected to the evaluations and the measurements in the same way as in Example 1. The results are shown in Table 1. A copy of an optical micrograph of the alloy structure observed on a cross section of an obtained alloy flake is shown in FIG. 5.

Comparative Example 5

Alloy flakes were prepared in the same way as in Comparative Example 4, and maintained at 850° C. for 120 minutes in an argon atmosphere. The resulting alloy flakes and pulverized powder prepared in the same way as in Example 1 were subjected to the evaluations and the measurements in the same way as in Example 1. The results are shown in Table 1.

Comparative Examples 6 to 8

Figure 6:
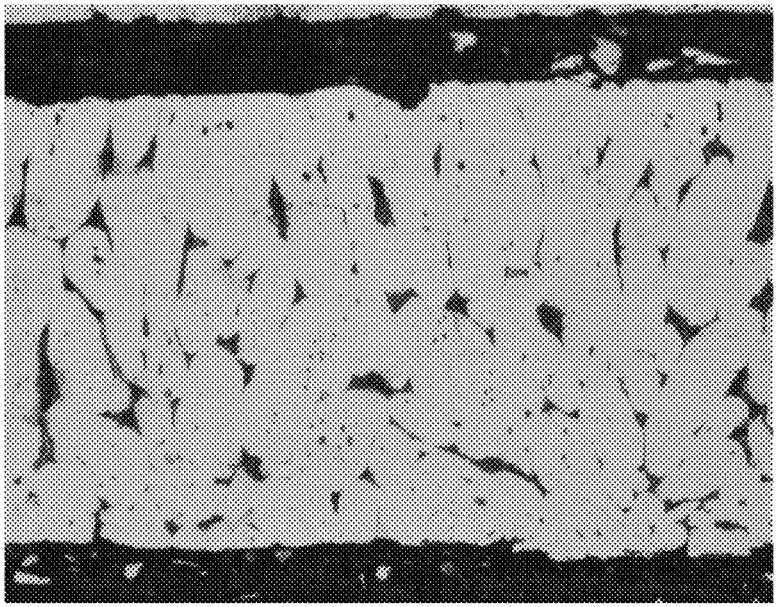
FIG. 6 is a copy of an optical micrograph of the alloy structure observed on a cross section of an alloy flake prepared in Comparative Example 8.

Alloy flakes were prepared in the same way as in Comparative Example 5 except that the heating temperature and the holding time were changed as shown in Table 1. The obtained alloy flakes and pulverized powder prepared in the same way as in Example 1 were subjected to the evaluations and the measurements in the same way as in Example 1. The results are shown in Table 1. A copy of an optical micrograph of the alloy structure observed on a cross section of an alloy flake prepared in Comparative Example 8 is shown in FIG. 6.

Example 5

An alloy was prepared in the following method using the production system 10 shown in FIG. 1 and the device 40 shown in FIG. 2 in a similar way as in Example 1.

Raw materials, Nd, Dy, B, Co, Cu, Al, and Fe were blended so that the total weight was 300 kg. The surface of the cooling roll 15, which was a water-cooled copper roll, was abraded in the direction of rotation of the roll and at 90° with respect to the direction of rotation using #60 sandpaper, so that the surface of the cooling roll had non-linear irregularities with an Ra value of 2.8 μm and an Rsk value of −0.40. The raw material were heated to melt in an argon atmosphere, poured at 1450° C. onto the cooling roll 15 via the tundish 14 to solidify continuously. The peripheral velocity of the cooling roll 15 was 1.0 m/sec. The alloy 17*a* rapidly cooled and solidified to 800 to 1000° C. on the cooling roll 15 was crushed on the alloy crusher plate 16 into alloy flakes 17*b*, and allowed to fall into the inlet 41*a* of the device 40. The fallen alloy flakes 17*b* were introduced into the pipe 41 of the device 40 while their surface temperature was not lower than 500° C., and maintained at 1000° C. for 20 minutes as the flakes 17*b* were continuously transferred through the pipe 41. The alloy flakes 17*b* were then introduced into the pipe 45, forced-cooled down to not higher than 100° C., and collected in the container 18. The obtained alloy flakes 17*c* had thicknesses of about 300 μm.

The composition of the obtained alloy flakes was analyzed with X-ray fluorescence and ICP to be 25.0 mass % Nd, 4.9 mass % Dy, 0.95 mass % B, 0.15 mass % Al, 1.0 mass % Co, 0.2 mass % Cu, and the balance iron.

Figure 7:
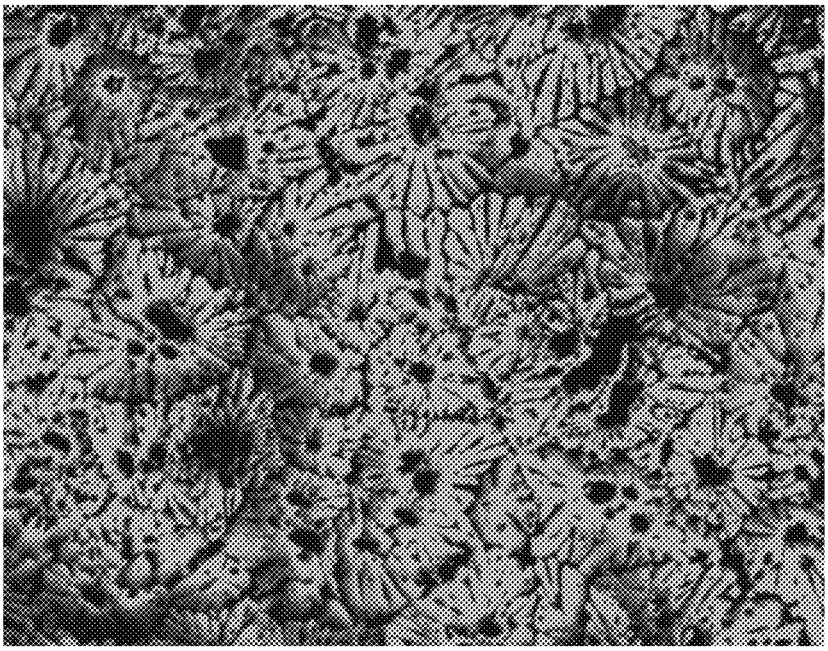
FIG. 7 is a copy of an optical micrograph of the alloy structure observed on a face of an alloy flake prepared in Example 5 which was in contact with the cooling surface of the roll.

The face of an obtained alloy flake which had been in contact with the surface of the cooling roll was observed in the above-mentioned manner to find that the number of the crystals was 12 which were dendrites grown radially from the point of nucleation, had an aspect ratio of 0.5 to 1.0 and a crystal grain size of not smaller than 30 μm, and crossed the line corresponding to 880 μm. Observation of the sectional structure of the alloy flake revealed no chill crystals. An optical micrograph of the face of the alloy flake which had been in contact with the surface of the cooling roll is shown in FIG. 7.

TABLE 1

| | Heating temperature (° C.) | Holding time (min) | Average distance between R-rich phases (μm) | Standard deviation σ of distances between R-rich phases | Distance between R-rich phases σ/AVE | D50 (μm) | Uniformity n | Number of B-rich phases (count) | TRE yield (%) |
|---|---|---|---|---|---|---|---|---|---|
| Ex. 1 | 950 | 5 | 10.1 | 1.84 | 0.18 | 5.6 | 2.07 | 4 | 99.3 |
| Ex. 2 | 950 | 60 | 16.0 | 3.05 | 0.19 | 6.3 | 2.02 | 3 | 99.5 |
| Ex. 3 | 1030 | 5 | 11.1 | 1.85 | 0.17 | 5.7 | 2.13 | 1 | 99.4 |
| Ex. 4 | 1030 | 120 | 24.6 | 4.09 | 0.17 | 6.7 | 2.09 | 1 | 99.6 |
| Comp. Ex. 1 | 850 | 5 | 8.3 | 1.45 | 0.18 | 5.2 | 2.01 | 0 | 98.0 |
| Comp. Ex. 2 | 850 | 60 | 9.7 | 1.97 | 0.20 | 5.5 | 2.03 | 1 | 98.3 |
| Comp. Ex. 3 | 1050 | 3 | 9.6 | 1.92 | 0.20 | 5.4 | 1.91 | 1 | 98.2 |
| Comp. Ex. 4 | — | — | 5.2 | 0.85 | 0.14 | 5.1 | 2.17 | 0 | 96.7 |
| Comp. Ex. 5 | 850 | 120 | 13.2 | 3.21 | 0.24 | 6.2 | 1.96 | 0 | 99.1 |
| Comp. Ex. 6 | 850 | 300 | 15.1 | 3.55 | 0.24 | 5.8 | 1.94 | 0 | 99.3 |
| Comp. Ex. 7 | 1000 | 60 | 16.5 | 4.39 | 0.27 | 6.1 | 1.89 | 0 | 99.5 |
| Comp. Ex. 8 | 1000 | 120 | 19.5 | 6.54 | 0.34 | 6.6 | 1.85 | 0 | 99.4 |

The alloy flakes and pulverized powder prepared in the same way as in Example 1 were subjected to the evaluations and the measurements in the same way as in Example 1. The results are shown in Table 2. The TRE yields in Examples 5 to 9 were yields of the TRE components (Nd+Dy) after the jet milling compared to before the jet milling. A sintered magnet was produced from the obtained pulverized powder. The magnetic remanence of the obtained sintered magnet was 13.58 kG, and the intrinsic coercivity was 23.78 kOe.

Example 6

Alloy flakes were prepared in the same way as in Example 5 except that the sandpaper was changed to #30 to give the surface of the cooling roll non-linear irregularities with an Ra value of 4.3 μm and an Rsk value of −0.32.

The obtained alloy flakes and pulverized powder prepared in the same way as in Example 1 were subjected to the evaluations and the measurements in the same way as in Example 1. The number of the crystals which were dendrites grown radially from the point of nucleation, had an aspect ratio of 0.5 to 1.0 an a crystal grain size of not smaller than 30 μm, and crossed the line corresponding to 880 μm, as well as the content of chill crystals, and the magnetic remanence and intrinsic coercivity of the sintered magnet were determined in the same way as in Example 5. The results are shown in Table 2.

Example 7

Alloy flakes were prepared in the same way as in Example 5 except that shotblasting was employed instead of the sandpaper to give the surface of the cooling roll non-linear irregularities with an Ra value of 6.3 μm and an Rsk value of −0.10.

The obtained alloy flakes and pulverized powder prepared in the same way as in Example 1 were subjected to the evaluations and the measurements in the same way as in Example 1. The number of the crystals which were dendrites grown radially from the point of nucleation, had an aspect ratio of 0.5 to 1.0 an a crystal grain size of not smaller than 30 μm, and crossed the line corresponding to 880 μm, as well as the content of chill crystals, and the magnetic remanence and intrinsic coercivity of the sintered magnet were determined in the same way as in Example 5. The results are shown in Table 2.

Example 8

Alloy flakes were prepared in the same way as in Example 5 except that the surface of the cooling roll was abraded with #60 sandpaper only in the direction of rotation of the roll to give the surface of the cooling roll linear irregularities with an Ra value of 2.3 μm and an Rsk value of −0.44.

The obtained alloy flakes and pulverized powder prepared in the same way as in Example 1 were subjected to the evaluations and the measurements in the same way as in Example 1. The number of the crystals which were dendrites grown radially from the point of nucleation, had an aspect ratio of 0.5 to 1.0 an a crystal grain size of not smaller than 30 μm, and crossed the line corresponding to 880 μm, as well as the content of chill crystals, and the magnetic remanence and intrinsic coercivity of the sintered magnet were determined in the same way as in Example 5. The results are shown in Table 2.

Example 9

Alloy flakes were prepared in the same way as in Example 5 except that the raw materials, Nd, Dy, B, Co, Cu, Al, Nb, and Fe were blended so that the total weight was 300 kg. The composition of the obtained alloy flakes was analyzed with X-ray fluorescence and ICP to be 27.5 mass % Nd, 4.9 mass % Dy, 1.00 mass % B, 0.15 mass % Al, 1.0 mass % Co, 0.2 mass % Cu, 0.15 mass % Nb, and the balance iron.

The obtained alloy flakes and pulverized powder prepared in the same way as in Example 1 were subjected to the evaluation and the measurements in the same way as in Example 1. The number of the crystals which were dendrites grown radially from the point of nucleation, had an aspect ratio of 0.5 to 1.0 an a crystal grain size of not smaller than 30 μm, and crossed the line corresponding to 880 μm, as well as the content of chill crystals, and the magnetic remanence and intrinsic coercivity of the sintered magnet were determined in the same way as in Example 1. The results are shown in Table 2.

TABLE 2

| | Heating temperature (° C.) | Holding time (min) | Average distance between R-rich phases (μm) | Standard deviation σ of distances between R-rich phases | Distance between R-rich phases σ/AVE | D50 (μm) | Uniformity n | Number of B-rich phases (count) | TRE yield (%) | Number of radial crystals (count) | Content of chill crystals (%) | Magnetic remanence (kG) | Intrinsic coercivity (kOe) |
|---|---|---|---|---|---|---|---|---|---|---|---|---|---|
| Ex. 5 | 1000 | 20 | 12.8 | 1.71 | 0.13 | 6.4 | 2.14 | 2 | 99.5 | 12 | 0 | 13.58 | 23.78 |
| Ex. 6 | 1000 | 20 | 13.1 | 1.79 | 0.14 | 6.3 | 2.14 | 3 | 99.4 | 8 | 0 | 13.67 | 23.81 |
| Ex. 7 | 1000 | 20 | 13.5 | 1.73 | 0.13 | 6.4 | 2.16 | 2 | 99.5 | 11 | 0 | 13.59 | 23.88 |
| Ex. 8 | 1000 | 20 | 12.9 | 2.14 | 0.17 | 6.3 | 2.02 | 2 | 99.3 | 3 | 5.9 | 12.90 | 23.66 |
| Ex. 9 | 1000 | 20 | 11.8 | 1.65 | 0.14 | 5.8 | 2.18 | 1 | 99.4 | 13 | 0 | 12.37 | 23.86 |

DESCRIPTION OF REFERENCE NUMERALS

10: production system
13: melting furnace
15: cooling roll
17: alloy melt
17*a*: alloy ribbons
17*b*, 17*c*: alloy flakes
40: device for controlling alloy crystal structure
41: pipe
42: heating section
45: tubular cooler

What is claimed is:

1. A method for producing alloy flakes for a rare earth sintered magnet, said alloy flakes having a composition of 27.0 to 33.0 mass % R, 0.90 to 1.30 mass % boron, and the balance M, wherein said R consists of one or more rare earth metal elements selected from the group consisting of lanthanoids and yttrium; and said M consists of iron, or of iron and at least one element selected from the group consisting of cobalt, aluminum, chromium, titanium, vanadium, zirconium, hafnium, manganese, magnesium, copper, tin, tungsten, niobium, gallium, silicon, and carbon, wherein, in a micrograph at a magnification of 100× of a face of each of said alloy flakes which was in contact with a cooling surface of the roll, the alloy flake contains 5 or more crystals crossing a line with a length of 880 μm, and each of the crystals is dendrite grown radially from a point of nucleation and has an aspect ratio of 0.5 to 1.0 and a crystal grain size of not smaller than 30 μm, and wherein, in a micrograph at a magnification of 200× of a cross section of each of said alloy flakes generally perpendicular to the face, an average distance between R-rich phases is 10 to 30 μm, and a value obtained by dividing the standard deviation of the distance between the R-rich phases by the average distance between the R-rich phases is not more than 0.20, said method comprising the steps of:

(A) preparing an alloy melt comprising R, boron, and the balance M, (B) rapidly cooling and solidifying said alloy melt by strip casting with a cooling roll down to not lower than 700° C. and not higher than 1000° C., wherein a surface of said cooling roll has non-linear irregularities with an Ra value of 2 to 15 μm and an Rsk value of not less than −0.5 and less than 0, and (C) heating alloy flakes separated from the cooling roll by said rapid cooling and solidifying in step (B), before said alloy flakes are cooled down to not higher than 500° C., wherein said heating in step (C) is effected by maintaining the alloy flakes at not lower than 950° C. and not higher than 1050° C. for 5 to 120 minutes.

2. The method according to claim 1, wherein said heating in step (C) is effected at not lower than 1000° C. and not higher than 1050° C.

3. The method according to claim 1, wherein said heating in step (C) is effected while the alloy flakes are continuously transferred.

4. Alloy flakes for a rare earth sintered magnet prepared by the method according to claim 1.

* * * * *